US007382996B2

(12) United States Patent
Lu et al.

(10) Patent No.: US 7,382,996 B2
(45) Date of Patent: Jun. 3, 2008

(54) METHOD FOR OPERATING A CLEANING STATION

(75) Inventors: Michael Q. Lu, Fairport, NY (US); Robert B. Anderson, Jr., Syracuse, NY (US); Douglas A. Lundy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 298 days.

(21) Appl. No.: 11/311,464

(22) Filed: Dec. 19, 2005

(65) Prior Publication Data

US 2007/0140720 A1 Jun. 21, 2007

(51) Int. Cl.
*G03G 15/00* (2006.01)

(52) U.S. Cl. ..... 399/71; 399/123; 399/343

(58) Field of Classification Search ..... 399/38, 399/46, 49, 71, 9, 34, 123, 343
See application file for complete search history.

(56) References Cited

U.S. PATENT DOCUMENTS

| | | | | |
|---|---|---|---|---|
| 5,839,020 | A * | 11/1998 | Rushing et al. | 399/49 |
| 5,862,432 | A * | 1/1999 | Nakayama et al. | 399/44 |
| 5,903,797 | A * | 5/1999 | Daniels et al. | 399/34 |
| 5,937,224 | A * | 8/1999 | Budnik et al. | 399/26 |
| 6,233,413 | B1 * | 5/2001 | Folkins | 399/71 |
| 6,600,895 | B2 * | 7/2003 | Fletcher et al. | 399/307 |
| 6,775,512 | B2 | 8/2004 | Thayer | |

* cited by examiner

*Primary Examiner*—Hoan H Tran
(74) *Attorney, Agent, or Firm*—Lloyd F. Bean, II

(57) ABSTRACT

A method for operating a cleaning device having a preclean charging device for improved cleaning latitude on an imageable surface, including: moving imageable surface in a process direction through a cleaning zone, selecting a portion of the imageable surface moving through the cleaning zone; providing an initial pre-clean current to the selected portion of the imageable surface; and during the moving step, changing, the preclean current to the selected portion of the imageable surface.

20 Claims, 3 Drawing Sheets

METHOD FOR OPERATING A CLEANING STATION

This invention relates to an electrostatographic printer or copier, and more particularly concerns a cleaning system for removing toner from an imaging surface.

Electrostatic brush (ESB) cleaners are designed to satisfy a requirement of cleaning a maximum toner mass entering the cleaner in a given number of passes through the cleaner. Generally these requirements are a maximum single pass cleaning requirement and a maximum two pass cleaning requirement. The single pass cleaning requirement is typically a residual toner mass on a photoreceptor belt following transfer under conditions of the highest developed mass (DMA) with the lowest transfer efficiency (TE). In some machines a mark-to-edge, or bleed edge, raises the single pass cleaning requirement to the highest DMA level. The two pass cleaning requirement is typically cleaning of untransferred control patches and/or untransferred images in jam recovery. These input densities are equal to the highest DMA. It has been demonstrated that a two pass cleaning requirement is equivalent to cleaning half of the required toner mass in a single pass.

The two pass cleaning requirement, except in the case of mark-to-edge machines, is much more stressful than the single pass cleaning requirement. Therefore, the cleaning brushes are designed to clean the two pass requirement. Half of the toner is cleaned in each pass through the cleaner. In designing the cleaner the speed of the brushes, the number of fibers on the brushes, the interference of the brushes to the photoreceptor belt, the electrical bias on the brushes and the number of brushes are chosen to clean the equivalent single pass toner input.

Conventional multiple electrostatic brush cleaners consist of two or more brushes electrically biased to remove toner and other debris from the photoreceptor surface of the photoreceptor belt. Prior to the brushes a preclean charge device adjusts the toner charge of the incoming toner to a natural tribo charging polarity of the toner. This is known as right sign toner. Toner that does not charge to the polarity of the majority of the toner in the preclean charging step is known as wrong sign toner. The first brushes are biased opposite to the polarity of the right sign toner so that this toner can be removed. The last cleaning brush is biased opposite to the first brushes so that the wrong sign toner can be removed. Since there is only a small percentage of the toner that is wrong sign only a single brush is ever needed to clean the wrong sign toner mass.

Conventional multiple electrostatic brush cleaners have their single pass toner cleaning capacity limited by the amount of right sign toner that can be cleaned by the first brushes and the amount of wrong sign toner that can be cleaned by the last brush. As more cleaning capacity is required, such as for an increase in machine process speed, additional right sign cleaning brushes or additional cleaning passes must be added. These additions to the cleaning system are undesirable. Additional cleaning brushes increase the size and cost of the cleaner and may not fit in the available machine space. Additional cleaning passes decrease the productivity of the machine by requiring a longer recovery from paper jams. Additional cleaning passes impact the xerographic control of the machine by requiring a longer time to clean process control patches.

Therefore, it is highly desirable to improve the cleaning latitude of these multiple electrostatic brush cleaners to provide improved performance in response to changing levels of DMA on the conductive surface and in response to changes in xerographic subsystems operating parameters (such as a transfer station).

There is provided a method for operating a cleaning device having a preclean charging device for improved cleaning latitude on an imageable surface, comprising: moving imageable surface in a process direction through a cleaning zone, selecting a portion of said of the imageable surface moving through the cleaning zone; providing an initial pre-clean current to the selected portion of the imageable surface; and during the moving step, changing, the preclean current to the selected portion of the imageable surface.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

BRIEF DESCRIPTION OF THE DRAWINGS

Other features of the present invention will become apparent as the following description proceeds and upon reference to the drawings, in which:

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the toner control apparatus of the present invention may be employed in a wide variety of devices and is not specifically limited in its application to the particular embodiment depicted herein.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

Figure 1:
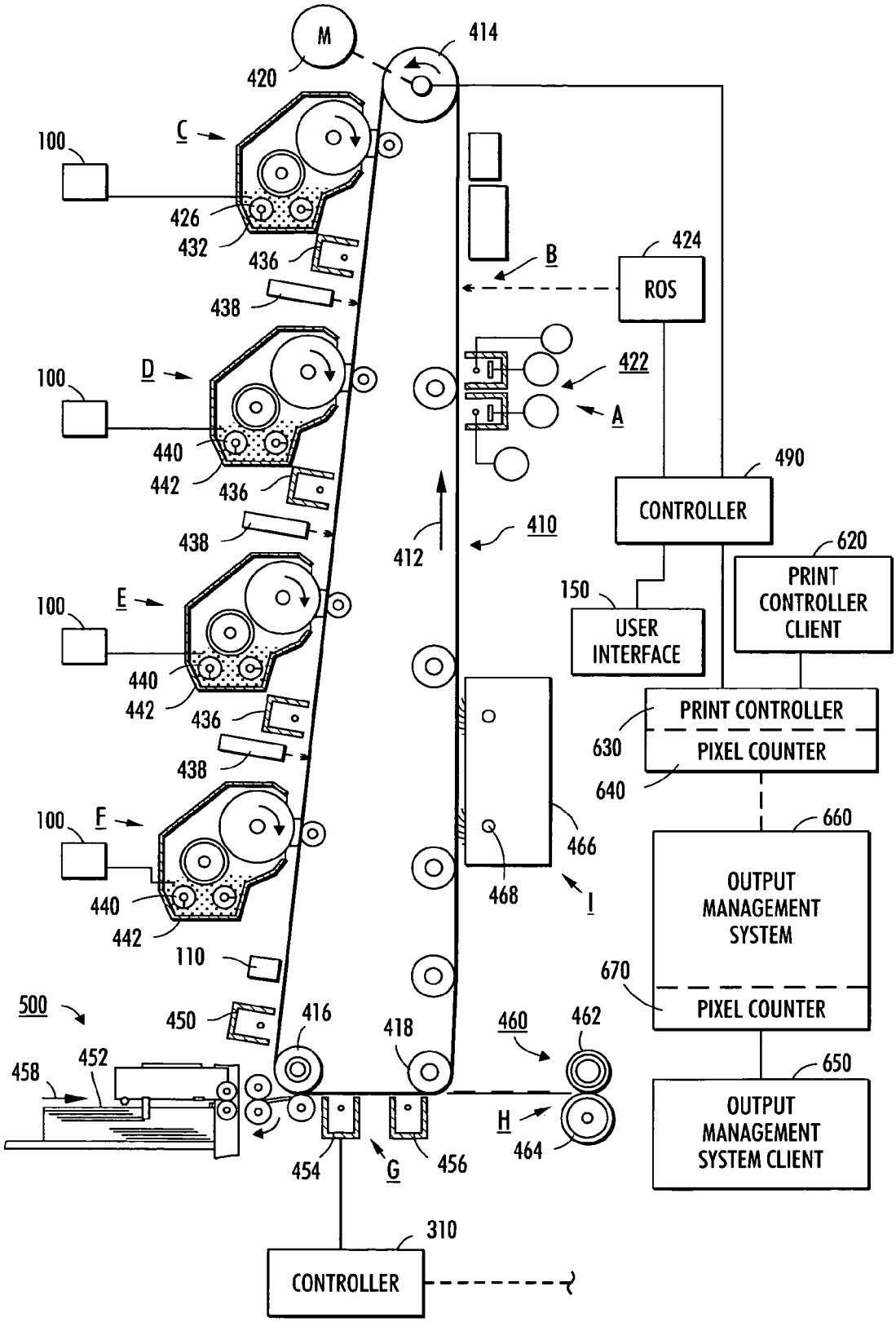
FIG. 1 is a schematic illustration of a printing apparatus incorporating the inventive features of the present invention.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

Figure 2:
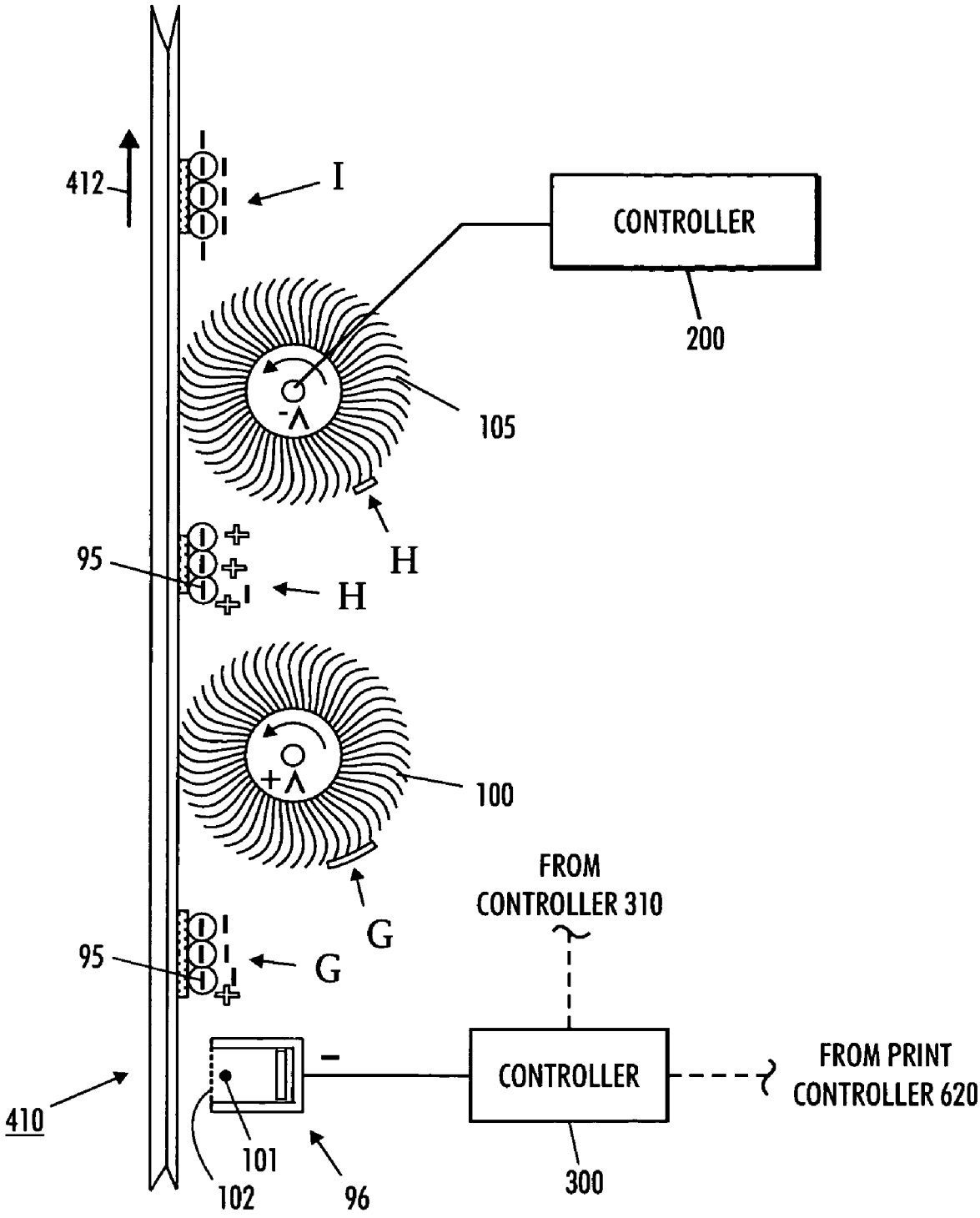
FIG. 2 is a schematic illustration of a Electrostatic brush (ESB) cleaner of the present invention.

Now focusing on an embodiment of cleaning station I illustrated in FIG. 2, which shows the conventional brush bias polarity for a dual electrostatic brush (DESB) cleaner to remove residual triboelectric negative toner particles from an imaging surface. A negative preclean corotron 96 provides negative charge to the residual triboelectric negative toner particles 95 remaining on the photoreceptor 410 (e.g. imaging surface) after transfer. A residual toner particle patch or toner patch G carries predominantly a high negative charge after preclean (although a small amount of low positive charge is present). The triboelectric negative toner particles 95 accept negative charge from the negative preclean corotron 96. This is an inherent toner characteristic that allows the triboelectric negative toner particles 95 to have a high negative charge value in the toner patch G. Thus, first cleaner brush 100, rotating against the direction of motion (shown by the arrow) of the photoreceptor 410, is positively biased to attract the predominantly negatively charged toner particles G from the photoreceptor 410. With typical post transfer residual toner input the positively biased first cleaner brush 100 removes almost all of the negatively charged toner in toner patch G that is later detoned from the first cleaner brush 100. However, a small portion of the toner patch G is often not cleaned by the first cleaner brush 100, (i.e. a small portion passes under the first cleaner brush 100 and a small amount may be redeposited from the first cleaner brush 100 onto the photoreceptor 410) and remains on the photoreceptor 410, after the first cleaner brush 100, as a toner patch H. For typical post transfer residual toner input the toner patch H of triboelectric toner 95 is predominantly positively charged after contact with the positively biased first cleaner brush 100 and of very low density. For high density inputs, such as experienced during jam recovery, control patch cleaning and other cases, toner patch G may not be substantially cleaned by the first cleaner brush 100. In this case toner patch H will consist largely of negatively charged toner particles at a relatively high density. In some instances a second pass is employed, as discussed supra, in the second pass of the two pass cleaning process the brush biases revert to the conventional polarities by controller 200 to clean any remaining toner, such as disclosed in U.S. Pat. No. 6,775,512 entitled "DUAL ELECTROSTATIC BRUSH CLEANER BIAS SWITCHING FOR MULTIPLE PASS CLEANING OF HIGH DENSITY TONER INPUTS", which is hereby incorporated by reference.

Now focusing operation of preclean corotron 96 of the present disclosure to maximize the cleaning latitude of Electro-Static Brush (ESB) cleaning. Preclean corotron 96 includes an electrode element 101 and a shield 102. A pre-clean corona treatment is applied to the incoming waste so that a consistent and predictable particle charge enters the cleaner brush. Applicants have found that any deviation or variability of the incoming waste will lead to a loss in latitude and an increase in service costs. To overcome the before mentioned problem, Applicants have found that with tight control of the charge on the incoming particles, other cleaning system parameters can be selected to maximize component lives and reduce operating costs.

In one mode of operation of preclean corotron 96, preclean current is varied in response to bias changes of the transfer station to improve cleaning latitude. For example, in systems that employ transfer switching to achieve particular desired behavior of the DC bias in the transfer zone. Such as disclosed in U.S. application Ser. No. 11/131,319, entitled "PHOTORECEPTOR CHARGING SYSTEMS AND METHODS" filed on May 17, 2005, which discloses Transfer Current Switching For Light Weight, Large Format and as disclosed in U.S. application Ser. No. 11/280,005 entitled "System and Method for Adjusting Transfer Current in an Image Transfer Machine" filed on Nov. 16, 2005, which discloses Transfer Current Switching For Low Area Coverage Deletions For Improved Print Quality.

In these systems, the varying of the DC bias in the transfer zone controlled by a control system within the printing apparatus, and this control system is generally shown in FIG. 2 as 310. The control system 310 can independently operate either the transfer corotron 454 or the detack corotron 456 to obtain the desired electrical properties within the transfer zone during the transfer process. As further can be seen in the Figure, the control system 310 can be ultimately accessed via a user interface (UI) indicated as 150. A particular desired behavior of the DC bias in the transfer zone. Similarly, the varying of the preclean shield current in the cleaning zone controlled by a control system within the printing apparatus, and this control system is generally shown in FIG. 2 as 300.

The control system 300 is in communication with control system 310 to operate preclean corotron 96 to obtain the desired electrical properties within the clean zone during the cleaning process. The preclean corotron can adjust the charge of the toner on the imageable surface at various points in the cleaning zone to a uniform desired target for optimal cleaning. This would require a closed loop feedback system providing the information to the preclean corotron controller as what the current state of the toner charge and its location on the imageable surface so that the controller can adjust the output accordingly. In the case when sheets are being printed moves through the transfer zone, the preclean shield current is adjusted in response to the transfer DC bias as a selected portion of the imageable surface corresponding the sheet moves through the cleaning zone. One method to accomplish the following is when a lead edge of the sheet is in the transfer zone, an initial transfer DC bias between the print sheet and the imageable surface; provides a triggering signal to controller 300 to generate an initial preclean current in response to the initial transfer DC bias, when the selected portion of the imageable surface is in the cleaning zone. Preferably switching of the preclean shield current is at substantially the same frequency as the transfer DC bias and also the preclean waveform employed substantially matches the transfer current wave form.

The controller 300 operation is illustrated in the following pseudo code

Obtain work unit packet describing next image.
Determine from work unit time when lead edge of this image will be passing the cleaner.
Determine from work unit time when trail edge of this image will be passing the cleaner.
When lead edge at cleaner time arrives, set preclean to sheet value.
When trail edge at cleaner time arrives, set preclean to IDZ value.

Where work unit packet equals all the information required to about the next image such as: paper media, timing information so the device knows where the image is on the belt, actual image description; work unit time equals timing code that is extracted from the work unit packet; Sheet value equals preclean shield current level in the sheet zone; and IDZ value equals preclean shield current level in the IDZ (interdocument zone).

Figure 3:
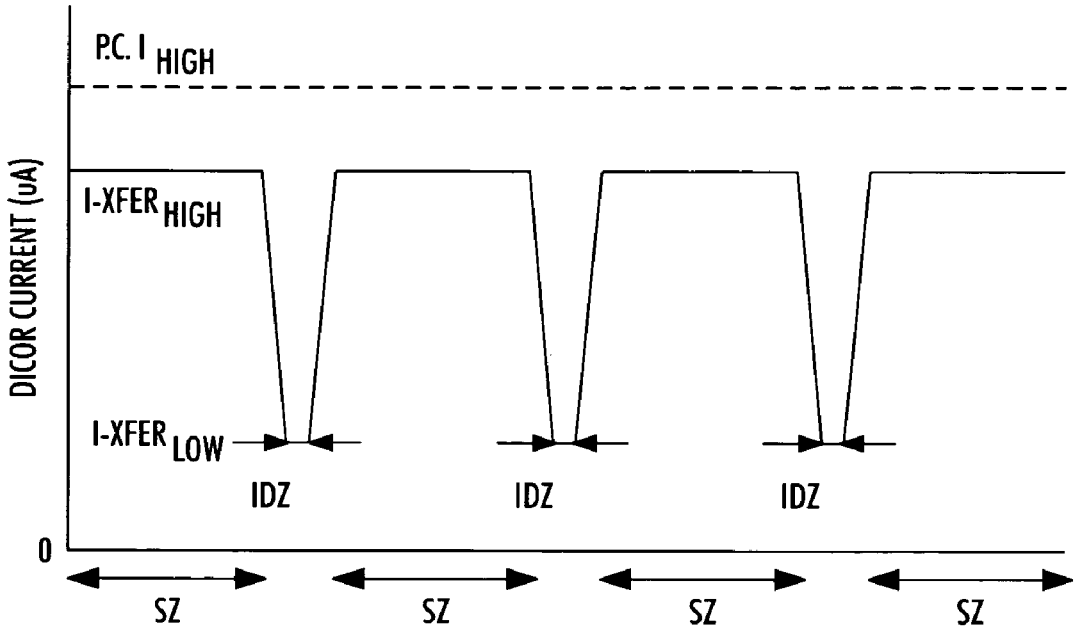
FIG. 3 is a graph illustrating a mode of operation where, the DC bias waveform in the transfer zone is not correlated to a corresponding preclean shield current.
Figure 4:
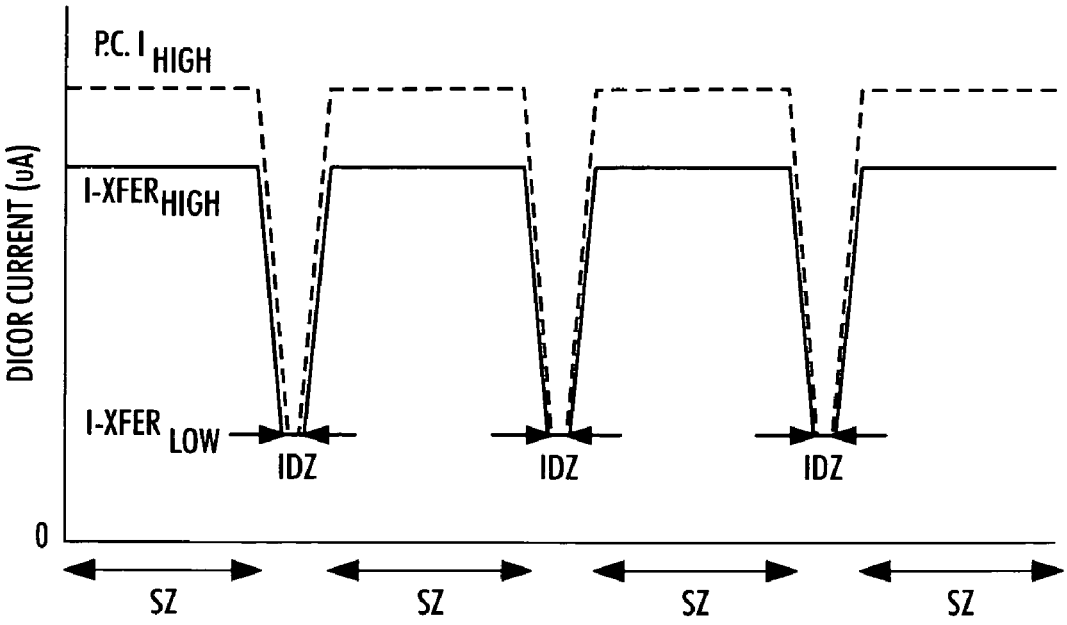
FIG. 4 is a graph illustrating a mode of operation where, the DC bias waveform in the transfer zone is correlated to a corresponding preclean shield current.

As shown in FIG. 3, the DC bias waveform in the transfer zone is not correlated to a corresponding preclean shield current. In FIG. 3, when the preclean current stays high and the transfer current goes low in the IDZ, the toner is highly negative in charge. The positive cleaning brush will not have enough positive charge to neutralize the highly negative toner in this area and thus it may require multiple passes to attain sufficient cleaning. To reduce the highly negative charge of the toner going into the positive cleaning brush, the preclean shield current is switch to a lower value for more optimal cleaning. As shown in FIG. 4, the DC bias waveform in the transfer zone is correlated to a corresponding preclean shield current. This allows the control of the toner on the imageable surface to be at its optimal charge for cleaning, especially for higher DMA patches.

The preclean corotron is a component in a DESB cleaner technology. This device charges the toner to an optimal state on the imageable surface prior to the first cleaning brush. Due to the multiple charging steps in the Xerographic process, the state of the toner can exhibit a variety of charge ranges prior to reaching the cleaner. The main concept of the present disclosure is to allow the preclean corotron output to change to either a higher or lower state from its initial in order to prepare the toner for optimal cleaning. FIG. 3 is one example of where the toner in the IDZ area can be very negative due to the transfer zone treatment of the toner to be a low positive state while the preclean corotoron is treating the toner to a high negative level. To compensate for the high negative toner charge in the IDZ cleaning area going into the cleaner brush, the preclean corotron output is adjusted to go low for better cleaning. If the state of the toner is known at any cleaning area on the imageable surface, the preclean corotron output may be adjusted to charge the toner accordingly.

In another embodiment, the control system 300 can independently operate preclean corotron 96 to obtain the desired electrical properties within the clean zone during the cleaning process. Selected a portions of said of the imageable surface, such as sheet zones; image areas; id zone and/or purge patches, and/or image areas having a predefined DMA wherein the initial pre-clean current is adjusted to obtain the desired electrical properties.

Placement on the imaging surface of these selected portions are known by Print Controller 630 which is in communication with controller 300 and Print Controller 630 sends a signal to controller 300 indicative of the type of the selected portion and when the selected portion will enter the cleaning zone whereupon controller 300 is varies the preclean shield current to improve cleaning latitude.

It is, therefore, apparent that there has been provided in accordance with the present invention, cleaning system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims

What is claimed is:

1. A method for operating a cleaning device having a preclean charging device for improved cleaning latitude on an imageable surface, comprising:

moving imageable surface in a process direction through a cleaning zone, selecting a portion of the imageable surface moving through the cleaning zone;

providing an initial pre-clean current to the selected portion of the imageable surface; and during the moving step, changing, the preclean current to the selected portion of the imageable surface.

2. The method of claim 1, wherein includes moving a print sheet relative to the imageable surface in a process direction through a transfer zone, and changing includes adjusting the preclean current in response to a transfer DC bias.

3. The method of claim 2, further comprising:

providing when a lead edge of the sheet is in the transfer zone, an initial transfer DC bias between the print sheet and the imageable surface;

triggering an initial preclean current in response to the initial transfer DC bias, when the selected portion of the imageable surface is in the cleaning zone.

4. The method of claim 3, wherein the triggering includes switching the preclean current at substantially the same frequency as the transfer DC bias.

5. The method of claim 4, the switching includes adjusting a preclean waveform to substantially match a transfer current wave form.

6. The method of claim 3, the triggering includes increasing the preclean current in a linear manner.

7. The method of claim 3, the triggering includes increasing the preclean current in at least one discrete step.

8. The method of claim 3, the triggering includes increasing the preclean current from a first value to a second value.

9. The method of claim 1, further comprising providing a first cleaning brush in the cleaning zone to remove toner from imageable surface.

10. The method of claim 9, further comprising providing a second cleaning brush in the cleaning zone to remove toner from the imageable surface.

11. The method of claim 10, wherein providing includes biasing said second cleaning brush with an opposite polarity of said first cleaning brush.

12. The method of claim 1, wherein the selected portion of the imageable surface is an interdocument zone.

13. The method of claim 1, wherein the selected portion of the imageable surface is a control patch.

14. A printing machine having a transfer station and a cleaning station including a cleaning device having a preclean charging device, a method for operating or improved cleaning latitude on an imageable surface, comprising:

moving imageable surface in a process direction through a cleaning zone, selecting a portion of the imageable surface moving through the cleaning zone;

providing an initial pre-clean current to the selected portion of the imageable surface; and during the moving step, changing, the preclean current to the selected portion of the imageable surface.

15. The method of claim 14, wherein includes moving a print sheet relative to the imageable surface in a process direction through a transfer zone, and changing includes adjusting the preclean current in response to a transfer DC bias.

16. The method of claim 15, further comprising:

providing when a lead edge of the sheet is in the transfer zone, an initial transfer DC bias between the print sheet and the imageable surface;

triggering an initial preclean current in response to the initial transfer DC bias, when the selected portion of the imageable surface is in the cleaning zone.

17. The method of claim 16, wherein the triggering includes switching the preclean current at substantially the same frequency as the transfer DC bias.

18. The method of claim 17, the switching includes adjusting a preclean waveform to substantially match a transfer current wave form.

19. The method of claim 14, further comprising providing a first cleaning brush in the cleaning zone to remove toner from imageable surface.

20. The method of claim 19, further comprising providing a second cleaning brush in the cleaning zone to remove toner from the imageable surface.

* * * * *